US006029296A

United States Patent [19]

Terrell

[11] Patent Number: 6,029,296

[45] Date of Patent: Feb. 29, 2000

[54] PILLOW APPARATUS WITH MEASURING ASSEMBLY

[76] Inventor: Kathy S. Terrell, 22239 Evangeline Rd., Pass Christian, Miss. 39571

[21] Appl. No.: 08/915,805

[22] Filed: Aug. 21, 1997

[51] Int. Cl.[7] ..... A47G 9/00

[52] U.S. Cl. ..... 5/639; 5/636; 5/485

[58] Field of Search ..... 5/636, 639, 413 R, 5/419, 485, 490; D10/72; 33/769

[56] References Cited

U.S. PATENT DOCUMENTS

| | | | |
|---|---|---|---|
| D. 25,973 | 8/1896 | Schiess | D10/72 |
| D. 255,510 | 6/1980 | Quenot | D10/72 |
| D. 284,056 | 6/1986 | Kinsley | D21/148 |
| D. 317,487 | 6/1991 | Tsukada | D6/598 |
| D. 337,471 | 7/1993 | Lemos | D6/601 |
| D. 373,920 | 9/1996 | Stephan | D6/599 |
| 1,264,341 | 4/1918 | Slater | 33/760 |
| 1,658,667 | 2/1928 | Buttigieg | D10/72 |
| 2,071,225 | 2/1937 | Buttigieg | 33/138 |
| 2,413,828 | 1/1947 | Hirsh et al. | 5/639 X |
| 4,590,633 | 5/1986 | Pickens | 5/485 X |
| 4,754,512 | 7/1988 | Chao-Yang | 5/419 X |
| 5,099,530 | 3/1992 | Scott | 5/419 X |

FOREIGN PATENT DOCUMENTS

| | | | |
|---|---|---|---|
| 1023202 | 1/1958 | Germany | 5/482 |

*Primary Examiner*—Michael F. Trettel
*Assistant Examiner*—Robert G. Santos
*Attorney, Agent, or Firm*—Garvey, Smith, Nehrbass & Doody, LLC

[57] ABSTRACT

A pillow apparatus which is placeable on furniture or on the floor, this includes a top surface, a bottom surface and stuffing material contained therein for forming the soft pillows upon one would wish to rest their head. The pillow apparatus further includes a reversible pocket formed along at least a portion of the pillow, with the pocket extendable between a first tucked in position within the pillow and an extended position out of the pillow. There is further provided a length of material secured to the distal end of the pocket which is extendable a predetermined distance such as six feet, so that when the pocket is extended from the pillow and the material is extended its full length, the distal end of the material is placed adjacent the television set, and the pillow is therefore positioned a reasonable distance from the monitor such as, for example, six feet, so that when the child rests their head upon the pillow, their eyes are approximately six feet away from the television monitor which is considered a safe distance. The upper side of the pillow would be decorative in the form of any animal's face, with the reversible pocket and extended fabric from the pocket resembling the tongue of the animal extending therefrom.

6 Claims, 2 Drawing Sheets

PILLOW APPARATUS WITH MEASURING ASSEMBLY

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The apparatus of the present invention relates to pillows. More particularly, the present invention relates to a pillow apparatus which incorporates a measuring feature for determining a safe distance that a person may place the pillow from a potential hazard such as a viewing monitor, a television set, a fireplace, an oven, etc., or any place needed for a safe distance in order to avoid adverse effects.

2. General Background of the Invention

It is a fact that people, and more in particularly children, spend an inordinant amount of time sitting or laying before a television set during the course of the day, whether it be to watch television, or to play games, such as video games on the television monitor. Experts agree that children, in all likelihood, watch an inordinant amount of television, and should be involved in more active recreational sports. However, recognizing the fact that children will continue to spend a great deal of time in front of a television monitor, one must address the problem of the harmful aspects that it may have to a child's eyes, or perhaps even to the child's well being overall. Experts in the field agree that children should be a safe distance from the television monitor while watching television or playing video games, so that it reduces the strain on the child's eyes, and perhaps even places him out of range of any harmful side effects that may come about from being placed too close to the energized monitor. At this point, there is no art as far as applicant can ascertain, which specifically addresses a means for maintaining a child at a safe distance from a television set, other than placement of the furniture a certain distance away from the set, and hoping that the child watches television while seated in the piece of furniture. However, as most people are aware, a great deal of the time that a child watches television, the child is laying prone on the floor looking up at the screen of the television and in most cases, as close to the television screen as they can position themselves. Therefore, there is a need in the art for addressing this problem and for making it more attractive to a child so that a child will maintain a safe distance from a television set while viewing the television.

In a search of the art, there were patents which were found which were although not particularly pertinent, are listed in the prior art statement being submitted herewith.

BRIEF SUMMARY OF THE INVENTION

The apparatus of the present invention solves the shortcomings in the art in a simple and straightforward manner. What is provided is a pillow apparatus for children which is placeable on furniture or on the floor, this includes a top surface, a bottom surface and stuffing material contained therein for forming the soft pillow upon which a child would rest her head. The pillow apparatus further includes a reversible pocket formed along at least a portion of the pillow, with the pocket extendable between a first tucked in position within the pillow and an extended position out of the pillow. There is further provided a length of material secured to the distal end of the pocket which is extendable a predetermined distance such as six feet, so that when the pocket is extended from the pillow and the material is extended its full length, the distal end of the material is placed adjacent the television set, and the pillow is therefore positioned a reasonable distance from the monitor such as, for example, six feet. When the child rests their head upon the pillow, their eyes are approximately six feet away from the television monitor which is considered a safe distance. The upper side of the pillow would be decorative in the form of an animal's face, with the reversible pocket and extended fabric from the pocket resembling the tongue of the animal extending therefrom.

Therefore, it is the principal object of the present invention to provide a pillow apparatus which enables a child to position the pillow apparatus a safe distance from a television set through the use of a feature of the apparatus resembling the tongue of an animal.

It is a further object of the present invention to provide a pillow apparatus which configures itself from a pillow having a pocket tucked into itself housing a length of extendable fabric, to a second position where the pocket is extended from the pillow and the fabric is drawn to a predetermined length such as six feet.

It is a further object of the present invention to provide a system for allowing a child to place a pillow a safe distance from a television monitor in a safe and yet whimsical manner, so that the child will consider the placement of the pillow an exercise in playing, and therefore maintain the pillow that safe distance from the television monitor.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 2:
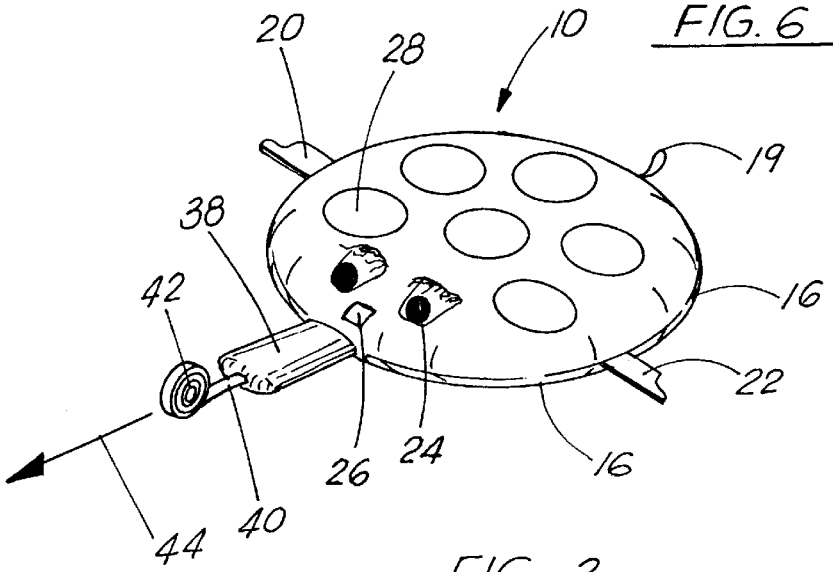
FIG. 2 illustrates a perspective view of the apparatus of the present invention with the pocket extending from the pillow and the fabric wound upon itself.
Figure 3:
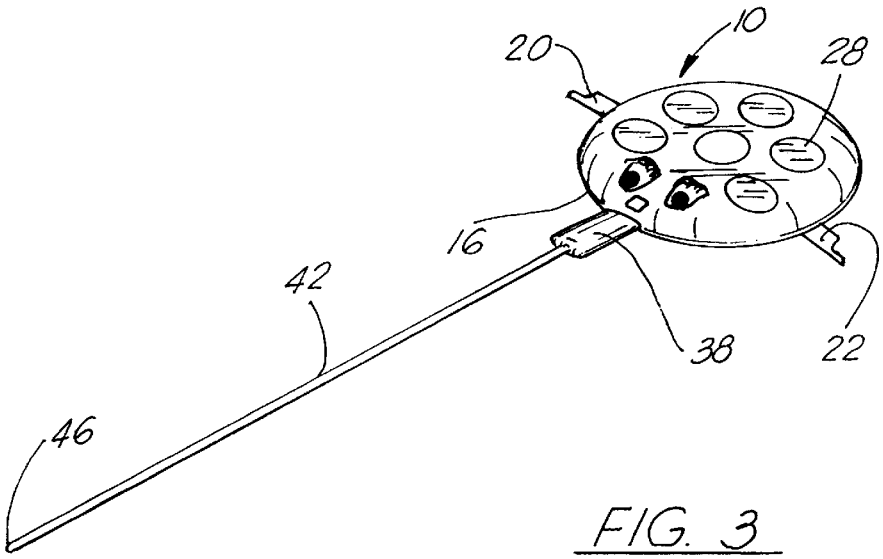
FIG. 3 illustrates an overall view of the preferred embodiment of the apparatus of the present invention with the pocket extended from the pillow and the fabric completely unwound to its predetermined length.
Figure 4:
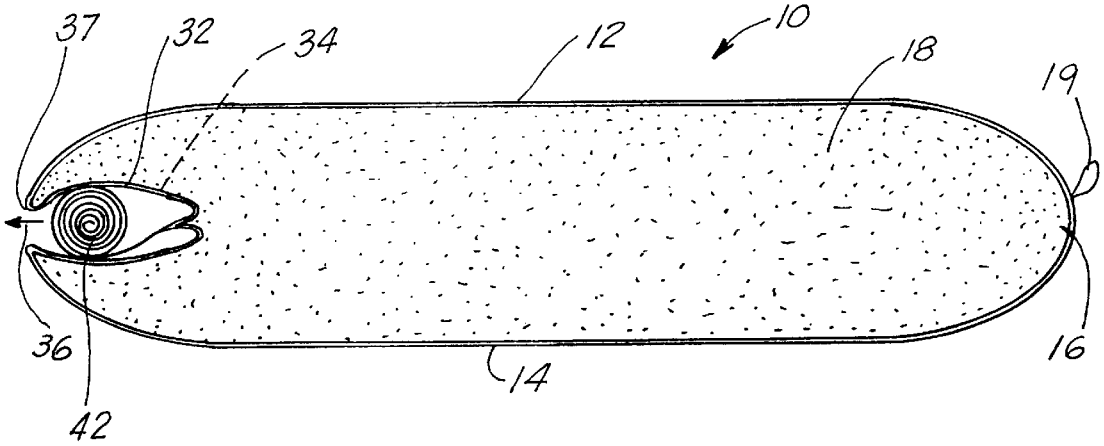
FIG. 4 illustrates a cross sectional view of the apparatus of the present invention with the pocket and length of fabric stored within the pillow itself.
Figure 5:
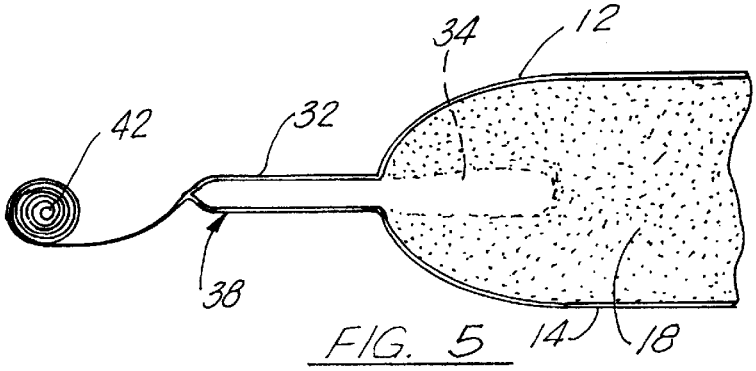
FIG. 5 illustrates a partial cross sectional view of the pocket extending from the apparatus and the length of fabric rolled upon itself.

FIGS. 1–6 illustrate the preferred embodiment of the apparatus of the present invention by the numeral 10. As seen in the Figures, pillow apparatus 10 comprises a first upper surface 12 upon which a person would lay one's head, a second lower surface 14 which would rest upon a surface such as the floor or the like, and with the surface 12 and 14 sewn together at a common circumferential seam 16 as seen clearly in FIG. 2, with a carrier loop 19, as seen in FIG. 4, for enabling the child to easily carry the pillow 10. As noted in cross sectional view in FIG. 4, pillow apparatus 10 would be stuffed with a common material such as cotton or other type of foam material 18 which serves to give the pillow its bulk so that one may rest one's head comfortably on the pillow. It should be noted that for purposes of this application, the pillow apparatus 10 would be particularly suitable for children, and such being the case, reference is made to FIGS. 1–3, which identify additional outer decorative aspects of the pillow which make it more attractive to a child. This pillow apparatus would be designed in order to give it a more life-like form in that it may include a pair of appendages 20, 22, extending from the side edge 16, eyes 24, a nose 26 and a plurality of circular spots 28 which may be of various colors so that in combination would resemble a more friendly type and playful toy rather than a simple pillow.

Turning now to a more functional aspect of the pillow, reference is made to the Figures where the pillow 10 in its features includes a mouth 30, which could be maintained in the closed position via Velcro strips 37. The mouth 30 as seen in side view in FIG. 4, is actually a length of fabric 32 folded upon itself within an opening 34 which when it is not folded upon itself as seen in FIG. 4, can be extended outward in the direction of arrow 36. When this is done, reference is made to FIGS. 2 and 5, where the pocket then forms what could be considered a large tongue portion 38 of the decorative pillow, with the tongue portion 38 actually formed from the fabric layer 32 of the pocket as seen in FIG. 4. Further, the tongue member 38 would further comprise an extendable fabric member 40 which as seen in FIG. 2 forms a roll or a bunch 42 so that when the pocket is folded upon itself as seen in FIG. 4, the fabric roll 42 can be secured within the pocket opening 34.

However, when the pocket is pulled outward in the direction of arrow 36, the fabric roll 42 may then be unrolled in the direction of arrow 44 as seen in FIG. 2, and can be fully extended as seen in FIG. 3. In the preferred embodiment, the distance between the outer edge 16 of pillow 10 and the end 46 of fabric member 42 would be the distance D as seen in FIG. 6 and would preferably be six feet.

Figure 1:
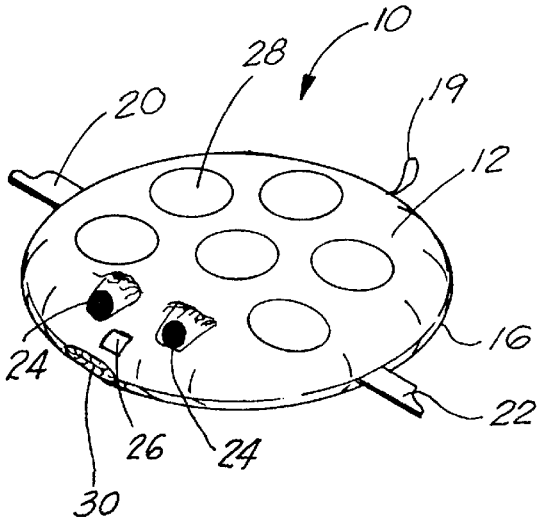
FIG. 1 illustrates an overall view of the preferred embodiment of the apparatus of the present invention with the pocket stored within the pillow itself.
Figure 6:
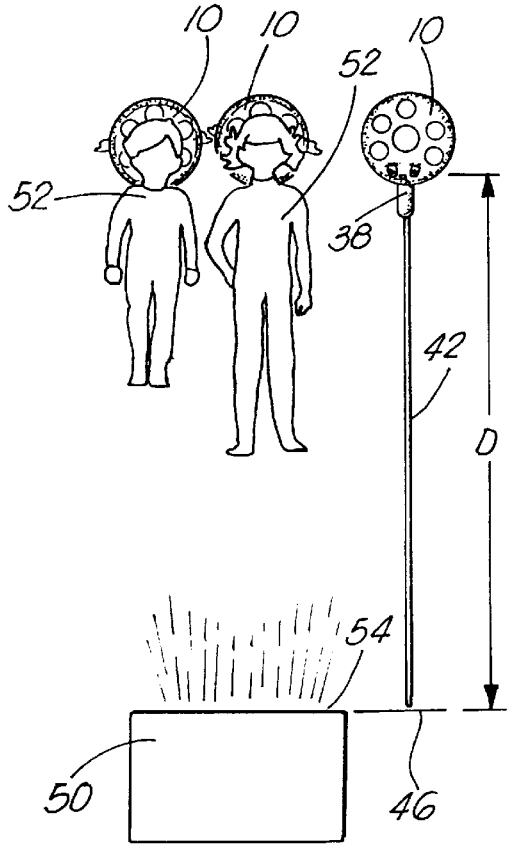
FIG. 6 illustrates an overall view of the apparatus positioned before a television monitor with the pocket and length of fabric extended their pre-determined distance, and with children laying onto such pillows.

Turning now to FIG. 6, in the utilizing of the pillow apparatus for its intended use, there is illustrated television monitor 50 which is being viewed by children 52, each of the children 52, for example, having their head each upon the pillow apparatus 10. As further seen in FIG. 6, there is illustrated a third pillow apparatus 10 which identical to the pillows as seen in FIG. 6, wherein the tongue member 38 is fully extended therefrom and the fabric member 42 is likewise extended so that the end 46 of the fabric member is adjacent the front edge 54 of the television set 50. In the preferred embodiment, when the pillow is in the position as shown, with the tongue 38 and fabric member 42 fully extended, the distance D is six feet, which is considered a safe distance between the pillow 10 and the television set 50. Therefore, when the children 52 have extended the tongue 38 and fabric member 42 their full length, the children may then rest their heads on the pillow 10, and they are viewing the television 50 from what can be considered a safe distance. When the viewing is complete, and the pillow 10 should be put away, the fabric member 42 is bunched or rolled in the configuration as seen in FIG. 2, and the tongue is pushed within the opening 34 of pillow 10, to form the pocket 32, and the fabric member is then positioned within the opening 34 for storage, as seen in FIG. 1. Therefore, when the pillow is in the storage configuration as seen in cross section view in FIG. 4, on the exterior it is actually as seen in FIG. 1, which can then be stored away in a closet or simply placed on a sofa or bed as would a regular pillow.

Although the drawings make reference to a pillow apparatus, it is foreseen that the concept of the apparatus with a means for measuring its distance from a viewing monitor such as a television set could have other forms. For example, the apparatus may be a bean bag chair which a child could be seated in, and from a portion of the front of the chair, have a pocket upon which a length of fabric such as tongue 38 could extend therefrom the predetermined distance, so that the child could place the bean bag chair at that distance from the monitor prior to being seated in the chair. It is therefore foreseen that the concept is to assure that the item, whether it be a child's pillow, bean bag chair, or any type of other item upon which a child may be seated for resting could include that type of a measuring means so as to avoid the item from being place at less than safe distance from the screen of the monitor.

The foregoing embodiments are presented by way of example only; the scope of the present invention is to be limited only by the following claims.

PARTS LIST

The following is a list of suitable parts and materials for the various elements of the preferred embodiment of the present invention.

| | |
|---|---|
| pillow apparatus | 10 |
| upper surface | 12 |
| lower surface | 14 |
| seam | 16 |
| side edges | 16 |
| material | 18 |
| carrier loop | 19 |
| appendages | 20, 22 |
| eyes | 24 |
| nose | 26 |
| spots | 28 |
| mouth | 30 |
| fabric | 32 |
| opening | 34 |
| arrow | 36 |
| Velcro strips | 37 |
| tongue portion | 38 |
| fabric member | 40 |
| fabric roll | 42 |
| arrow | 44 |
| end | 46 |
| distance | D |
| monitor | 50 |
| children | 52 |
| edge | 54 |

I claim:

1. A pillow apparatus having a measuring assembly, comprising:

a. a decorative pillow resembling a living creature, including a face portion of the pillow, the pillow having an upper surface with said face portion thereon and a lower surface connected along a common edge, and defining an enclosure for containing a soft stuffing material;

b. a pocket formed along at least the face portion of the pillow, and defining a mouth portion of the face portion, sized in relation to the size of the face portion and formed along a segment of said common edge; the mouth portion defining a storage space within the face portion of the pillow as a first position, and extendable out of the face portion of the pillow as a second position; and c. a length of fabric defining a tongue of the mouth portion of the pillow, the tongue extending from the mouth portion of the pillow, so that when the tongue is in the first position, the tongue is stored within the mouth portion, and when the tongue is in the second position, the tongue may be fully extended to define a pre-measured distance between a distal end of the tongue and the mouth portion of the pillow for establishing a safe distance between the pillow and a television monitor which is being viewed by a child's head resting on the pillow.

2. The pillow apparatus in claim 1, wherein the length of the fabric fully extended from the pocket in the second position would total six feet.

3. A pillow apparatus having an assembly for measuring the distance between the pillow and a television set, comprising:

a. a decorative pillow resembling a living creature, including a face portion of the pillow, the pillow having an upper surface with said face portion thereon and a lower surface connected along a common edge, and defining an enclosure for containing a soft stuffing material therein;

b. a pocket formed along at least the face portion of the pillow, and defining a mouth portion of the face portion, sized in relation to the size of the face portion and formed along a segment of said common edge; the mouth portion, in a first position, forming a storage space within the face portion of the pillow, and, in a second position, extendable out of the face portion of the pillow;

c. a length of fabric defining a tongue of the mouth portion of the pillow, the tongue extending from the mouth portion of the pillow, so that when the tongue is in the first position, the tongue is stored within the mouth portion, and when the tongue is in the second position, the tongue may be fully extended to measure a predetermined distance between a distal end of the tongue adjacent a front screen of the television set and the pillow, upon which a child's head is resting.

4. The pillow apparatus in claim 3, wherein the length of the fabric fully extended from the pocket in the second position would total six feet.

5. A pillow for accommodating a person thereupon, having an assembly for measuring the distance between the pillow and a television set, comprising:

a. a principal body portion having an upper surface upon which a person may rest, and a lower surface connected to said upper surface, and defining an enclosure for containing a soft cushioning material therein;

b. a pocket formed along at least a face portion on said upper surface of the pillow and defining a mouth portion of the face portion, sized in relation to the size of the face portion and formed along a segment of said common edge; the mouth portion in a first position, forming an opening which defines a storage space within the face portion of the pillow, and in a second position, extendable out of the face portion;

c. a length of fabric defining a tongue of the mouth portion of the pillow, the tongue extending from the mouth portion of the pillow, as the tongue is extended out of the body portion, so that when the tongue is in the first position, the tongue is stored within the mouth portion, and when the tongue is in the second position, the tongue may be fully extended, to measure a predetermined distance between a distal end of the tongue adjacent a front screen of the television set and the apparatus upon which a person is resting.

6. The apparatus in claim 5, wherein the distance between the distal end of the fabric and the apparatus measures six feet.

* * * * *